US006375493B1

(12) United States Patent
Lin

(10) Patent No.: US 6,375,493 B1
(45) Date of Patent: Apr. 23, 2002

(54) ELECTRICAL PLUG/SOCKET

(75) Inventor: James Lin, Taipei (TW)

(73) Assignee: Taiwan Line Tek Electronic Co., Ltd., Taipei Hsien (TW)

( * ) Notice: Subject to any disclaimer, the term of this patent is extended or adjusted under 35 U.S.C. 154(b) by 0 days.

(21) Appl. No.: 09/739,868

(22) Filed: Dec. 20, 2000

(30) Foreign Application Priority Data

Nov. 28, 2000 (TW) ..... 89220640 U

(51) Int. Cl.[7] ..... H01R 13/58
(52) U.S. Cl. ..... 439/457; 439/915
(58) Field of Search ..... 439/457, 915, 439/652, 501, 502, 456

(56) References Cited

U.S. PATENT DOCUMENTS 4,897,052 A * 1/1990 Priest et al. ..... 439/652
5,676,568 A * 10/1997 Weber ..... 439/694
5,848,916 A * 12/1998 Huang ..... 439/619
6,050,840 A * 4/2000 Kowalski et al. ..... 439/369

* cited by examiner

*Primary Examiner*—P. Austin Bradley
*Assistant Examiner*—Alexander Gilman
(74) *Attorney, Agent, or Firm*—Troxell Law Office PLLC

(57) ABSTRACT

An improved electrical plug/socket includes a seat being a fixed-shaped structure, one end thereof having an insert electrode, the other end thereof having a depression forming a seat chamber, the center having a through hole, a seat edge of an outer periphery being recessed to form a plurality of seat grooves; at least two insert electrodes formed from electrically conductive metal; and a lead wire connected to the insert electrodes and extending out of the through hole, and having an outer diameter corresponding to the seat groove so as to be insertable in the seat groove for guiding orientation.

3 Claims, 2 Drawing Sheets

ELECTRICAL PLUG/SOCKET

The primary object of the present invention is to provide an improved electrical plug/socket.

According to the preferred embodiment of the present invention, the improved electrical plug/socket comprising a seat being a fixed-shaped structure, one end thereof having an insert electrode, the other end thereof having a depression forming a seat chamber, the center having a through hole, a seat edge of an outer periphery being recessed to form a plurality of seat grooves. At least two insert electrodes formed from electrically conductive metal; and a lead wire connected to said insert electrodes and extending out of said through hole, and having an outer diameter corresponding to said seat groove so as to be insertable in said seat groove for guiding orientation.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 1:
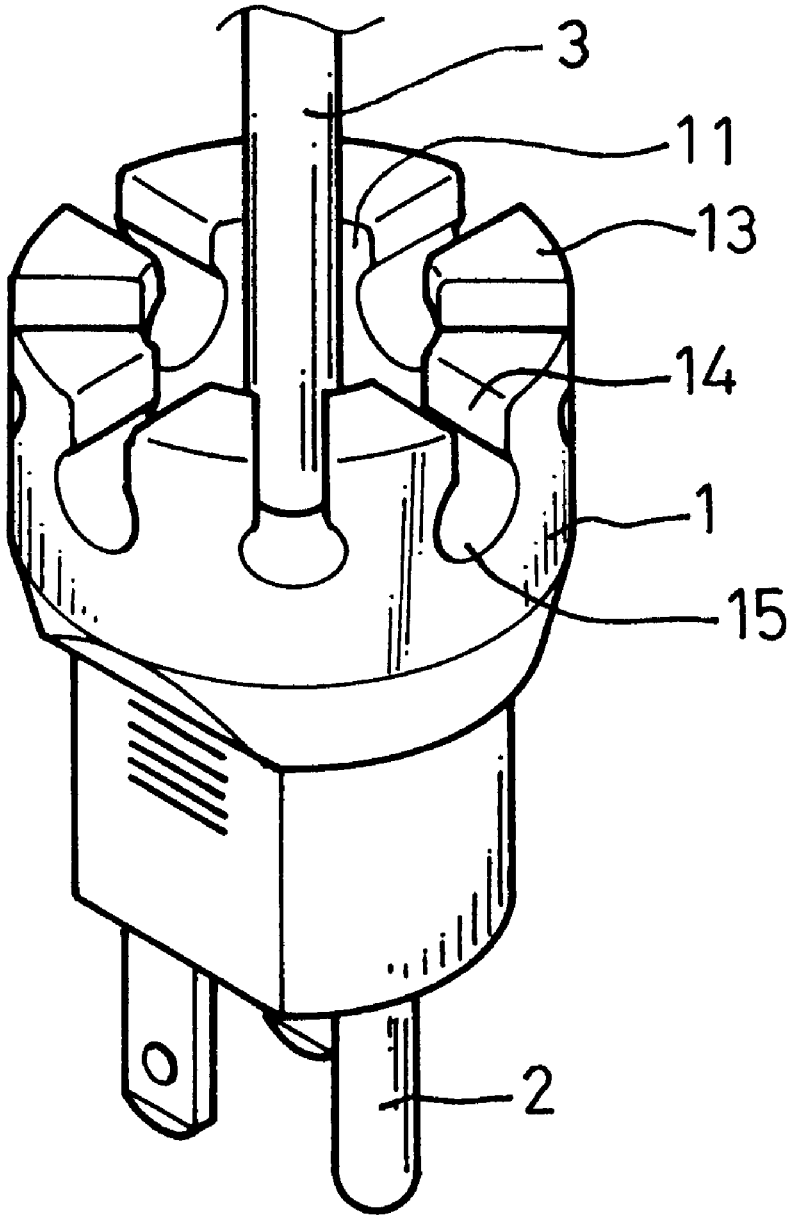
FIG. 1 is a schematic perspective view of the present invention.
Figure 3:
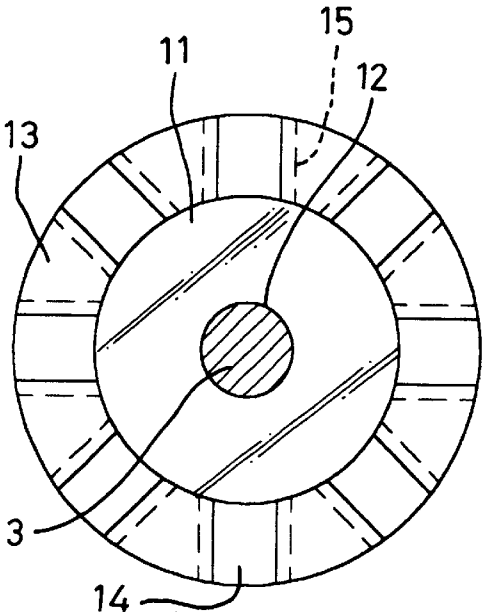
FIG. 3 is a right side view of the present invention.
Figure 2:
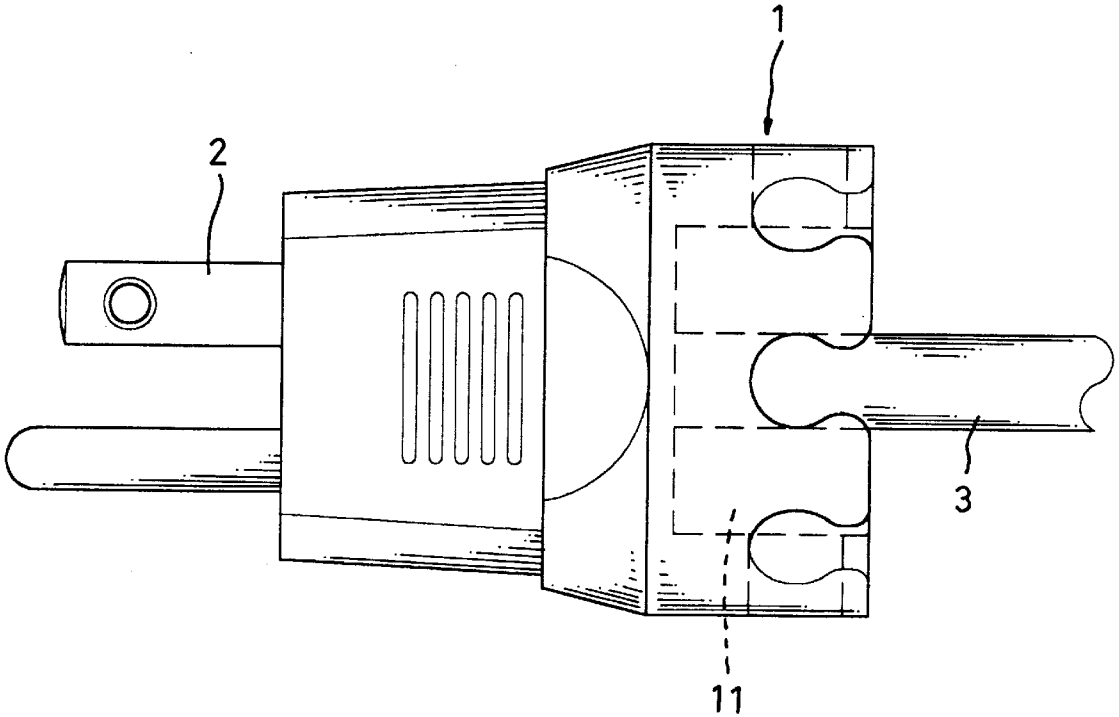
FIG. 2 is a front elevation view of the present invention.

With reference to the drawings, the electrical plug/socket according to the invention basically includes a seat 1, an insert electrode 2, and a lead wire 3.

The seat 1 is a fixed-shape structure. In this embodiment, it is circular, but it may also be rectangular, square, or any other shape. One end of the seat 1 that is opposite to the insert electrode 2 is centrally recessed to form a seat chamber 11, which is round in this embodiment but is not limited thereto, and which has a through hole 12 for extension of the lead wire 3 to be described hereinafter.

In addition, in order to accommodate the lead wire 3, a seat edge 13 at the outer periphery of the seat chamber 11 is recessed to form a plurality of seat grooves 14 which are preferably equidistantly spaced apart but is not limited thereto. The seat grooves 14 may be smaller at the upper end but larger at the lower end so that the bottom portion forms a bottom groove 15 corresponding to the outer diameter of the lead wire 3. In this embodiment, eight radially disposed seat grooves 14 are provided.

The insert electrode 2 is a known construction that projects outwardly from the seat 1 when served as a plug, but protrudes in a recess of the seat 1 when served as a socket, and is connected with the lead wire 3. The insert electrode 2 may include at least two electrodes, positive and negative, but a grounding electrode may also be provided. As this belongs to the prior art, a detailed description thereof is not given herein.

The lead wire 3 is an electrical wire that is connected with the insert electrode 2 and extends out of the through hole 12. The outer diameter thereof corresponds to the bottom groove 15 so that it can be received therein.

With further reference to the drawings, in practice, after insertion, the lead wire 3 may insert into the bottom groove 15 in the bottom portion of the seat grooves 14 according to the actually required orientation to serve as a direction guide and prevent entanglement. In addition, in actual practice, an upper cap that can inter-engage with the seat 1 may be additionally provided to prevent entry of foreign substances and for protection purposes. As this belongs to the prior art, a detailed description thereof is not given herein.

Therefore, by virtue of the invention, the problem concerning the fixed orientation of the lead wire of the plug/socket can be resolved since the lead wire can be lead out and positioned in different directions according to actual needs.

Although the present invention has been illustrated and described with reference to the preferred embodiment thereof, it should be understood that it is in no way limited to the details of such embodiment but is capable of numerous modifications within the scope of the appended claims.

What is claimed is:

1. An electrical connector comprising:

a) a body having an electrical connector portion on a first end of the body;

b) a lead wire extending from a second end of the body opposite to the first end; and c) an annular seat portion formed by an annular wall extending outwardly from the second end of the body, the annular wall extending around and spaced apart from the lead wire, the annular wall having a plurality at least three of spaced apart seat grooves therein, the plurality of seat grooves arranged in an annular array extending radially about the lead wire, each seat groove having a bottom portion configured to receive the lead wire therein and an upper portion smaller than a cross-sectional dimension of the lead wire, whereby the lead wire is retained in any one of the plurality of seat grooves.

2. The electrical connector of claim 1 wherein the electrical connector portion comprises an electrical plug.

3. The electrical connector of claim 1 wherein the plurality of seat grooves are equidistantly spaced apart.

* * * * *